US005638695A

United States Patent [19]

Kamio et al.

[11] Patent Number: 5,638,695

[45] Date of Patent: Jun. 17, 1997

[54] REFRIGERATING APPARATUS

[75] Inventors: Masaaki Kamio, Okazaki; Masashige Hiramatsu, Chita; Koji Kishita, Motosu-gun, all of Japan

[73] Assignee: Nippondenso Co., Ltd., Kariya, Japan

[21] Appl. No.: 490,519

[22] Filed: Jun. 14, 1995

[30] Foreign Application Priority Data

Jun. 15, 1994 [JP] Japan ..... 6-133149
Apr. 3, 1995 [JP] Japan ..... 7-077716

[51] Int. Cl.[6] ..... F25B 47/00

[52] U.S. Cl. ..... 62/279; 62/259.1; 165/DIG. 514; 165/134.1

[58] Field of Search ..... 62/259.1, 262, 62/279, 272; 203/86; 165/134, DIG. 514

[56] References Cited

U.S. PATENT DOCUMENTS 3,658,581 4/1972 Paul et al. ..... 203/86
4,100,764 7/1978 Murano ..... 62/262

FOREIGN PATENT DOCUMENTS 61-25530 8/1986 Japan .

OTHER PUBLICATIONS

Journal 22–097, Apr. 20, 1981, Nippondenso Technical Disclosure.

*Primary Examiner*—John M. Sollecito
*Attorney, Agent, or Firm*—Cushman, Darby & Cushman IP Group of Pillsbury Madison & Sutro LLP

[57] ABSTRACT

An evaporator 6 and a condenser 7, which are made of spine fin tubes 19, are arranged in the same vertical plane, so that the evaporator 6 is located at the top, while the condenser 7 is located at the bottom. Water condensed at the evaporator 6 drops onto an outer surface of the condenser 7. The water is moved along all of vertically spaced straight portions of the spine fine tubes 19 constructing the evaporator 7, which are in the same vertical plane. An increased staying time of the water on the evaporator 7 is, thus, obtained, thereby effectively evaporating the drained water due to the heat transferred from the evaporator 7.

11 Claims, 10 Drawing Sheets

REFRIGERATING APPARATUS

BACKGROUND OF THE INVENTION

1. Field of the Invention

The present invention relates to an integrated refrigerating apparatus wherein an evaporator and a condenser are integrated. The apparatus is suitable for use in a factory or an office.

2. Description of Related Art

An integrated refrigerating system is disclosed in Nippondenso Kokai Giho (Published Technical Report by Nippondenso) No. 22-097 on Apr. 20, 1981, wherein the refrigerating system includes a serpentine arrangement of a plurality of spine fin tubes, each of which has, on its outer surface, a plurality of spine fins formed as strips fixed to the outer surface. An evaporator as well as a condenser are constructed by such a serpentine arrangement of the spine fin tubes. In this case, the evaporator is arranged at the top, while the condenser is arranged at the bottom. Thus, water condensed at the evaporator at the top drops onto the condenser located at the bottom, so that the dropped water is vaporized by the condenser, thereby reducing the amount of water, which would otherwise be accumulated in a drain tank, and thereby reducing the amount of a manual work required for treatment of the drain water in the drain tank.

However, the inventors of this application have found that the serpentine arrangement of the spine fin tubes for constructing the evaporator and the condenser is defective in that the evaporation of water at the condenser is insufficient. Namely, according to a result of test on a serpentine arrangement of spine fin tubes in the prior art conducted by the inventors, drops of water generated on different spine fin tubes of the evaporator fall onto different spine fin tubes at the condenser, thereby reducing the time of residence of the water drops on the spine fin tubes at the condenser. Thus, effective evaporation of the droplets of the water cannot be obtained at the condenser.

The arrangement of an evaporator above a condenser is also shown in Japanese Examined Utility Model Publication No. 61-25530. In this prior art, both the evaporator and the condenser are constructed as plate fin types. As a result, a similar disadvantage is occurs in that droplets at an outer surface of the condenser from the evaporator may easily drop to a drain tank without being retained for a long time at the condenser. As a result, the effective use of the droplets to increase the condensing capacity cannot be obtained, despite the vertically spaced arrangement of the evaporator and the condenser.

Japanese Unexamined Utility Model Publication (Kokai) No. 61-25530 also discloses a refrigerating device wherein an evaporator of a plate fin type is arranged above a condenser of a plate fin type so that the evaporator and the condenser are located in a vertical plane. In this prior art, water dropping from the evaporator can pass through the condenser. However, the plate fin type condenser is not suitable for keeping the water on the surface of the condenser for a long time. Thus, the water is relatively quickly moved to a drain pan arranged at the bottom. Thus, an increased condensing capacity cannot be obtained.

SUMMARY OF THE INVENTION

An object of the present invention is to provide a refrigerating apparatus, capable of obtaining an increased stay time of the water on the condenser.

Another object of the present invention is to provide a refrigerating apparatus, capable of obtaining an increased performance of a treatment for the water at the condenser.

According to the present invention, a refrigerating apparatus is provided comprising:

a compressor;

a condenser;

means for generating an air flow contacting the condenser to transfer heat from the condenser to the air flow;

an evaporator arranged at a location above the condenser;

means for generating an air flow contacting the evaporator to transfer heat from the air flow to the evaporator, and;

a pressure reducer arranged between the condenser and the evaporator;

an arrangement of the compressor, the condenser, the evaporator and the pressure reducer executing a refrigerating cycle such that a compressed refrigerant from the compressor is condensed a the condenser, and, the refrigerant is, after pressure reduction at the pressure reducer, evaporated at the evaporator;

the evaporator and the condenser being located in substantially the same plane;

the evaporator and the condenser being a spine fin tube type comprising a central tube and spine fins on an outer cylindrical surface of the tube along substantially the entire surface thereof.

According to the present invention, the evaporator and the condenser are constructed from the spine fin tube, which are located on the same plane, to allow water from the evaporator to drop onto the condenser. Thus, an increased stay time of the drain water on a portion of the spine fin tube, of which the condenser is constructed, is obtained, thereby effectively evaporating the drain water at the condenser. In other words, an increased amount of the water which is used at the condenser can be obtained.

Advantageously, each of the spine fins is of a substantially rectangular shape and extends radially from outer cylindrical surface of the tube. The drain water moves along the rectangular shaped spine fins distributed along the entire portion of the condenser. Thus, a uniform distribution of the drain water can be obtained.

Advantageously, the spine fin tube is formed as a serpentine arrangement having a plurality of straight portions vertically spaced in parallel and curved portions connecting the straight portions with each other, and means for obtaining a fixed arrangement of the spine fin tube in the casing. The drained water moves along the straight portions, thereby providing an increased stay time of the water at the condenser.

Advantageously, the connecting means comprise a pair of horizontally spaced supporting members, each supporting member extending, substantially, vertically, and means for fixedly connecting the looped portions of the spine fin tube to the respective supporting members. This construction makes it possible to simplify fixing the spine fin tube thereby reducing cost.

Advantageously, said spine fin tube is provided, at its outer surface, with a coating made of hydrophilic material. Thus, an increased attachment of drained water to the surface of the fins can be obtained, thereby obtaining an effective evaporation of the drained water.

Advantageously, the spine fins are overlapped with each other between the straight portions, which are vertically adjacent with each other. Thus, an increased space utilization efficiency is obtained, thereby reducing an entire size of the apparatus.

Advantageously, said condenser has a thickness larger than that of the evaporator, and a portion of condenser thicker than the evaporator is projected in a downward direction of the flow of the air contacting the condenser. Thus, the drain water entrained in the air flow can be directed to the projected portion of the condenser, thereby effectively evaporating the condensed water.

Advantageously, the apparatus is for cooling an electric control box having a passageway in which at least one member generating a heat and to be cooled is arranged, and wherein said first air inlet and first air outlet is located in the passageway in the electric control device. Thus, an increased amount of treatment of the drained water is obtained, while effectively cooling the electric control board.

BRIEF EXPLANATION OF ATTACHED DRAWINGS

DESCRIPTION OF PREFERRED EMBODIMENTS

Figure 1:
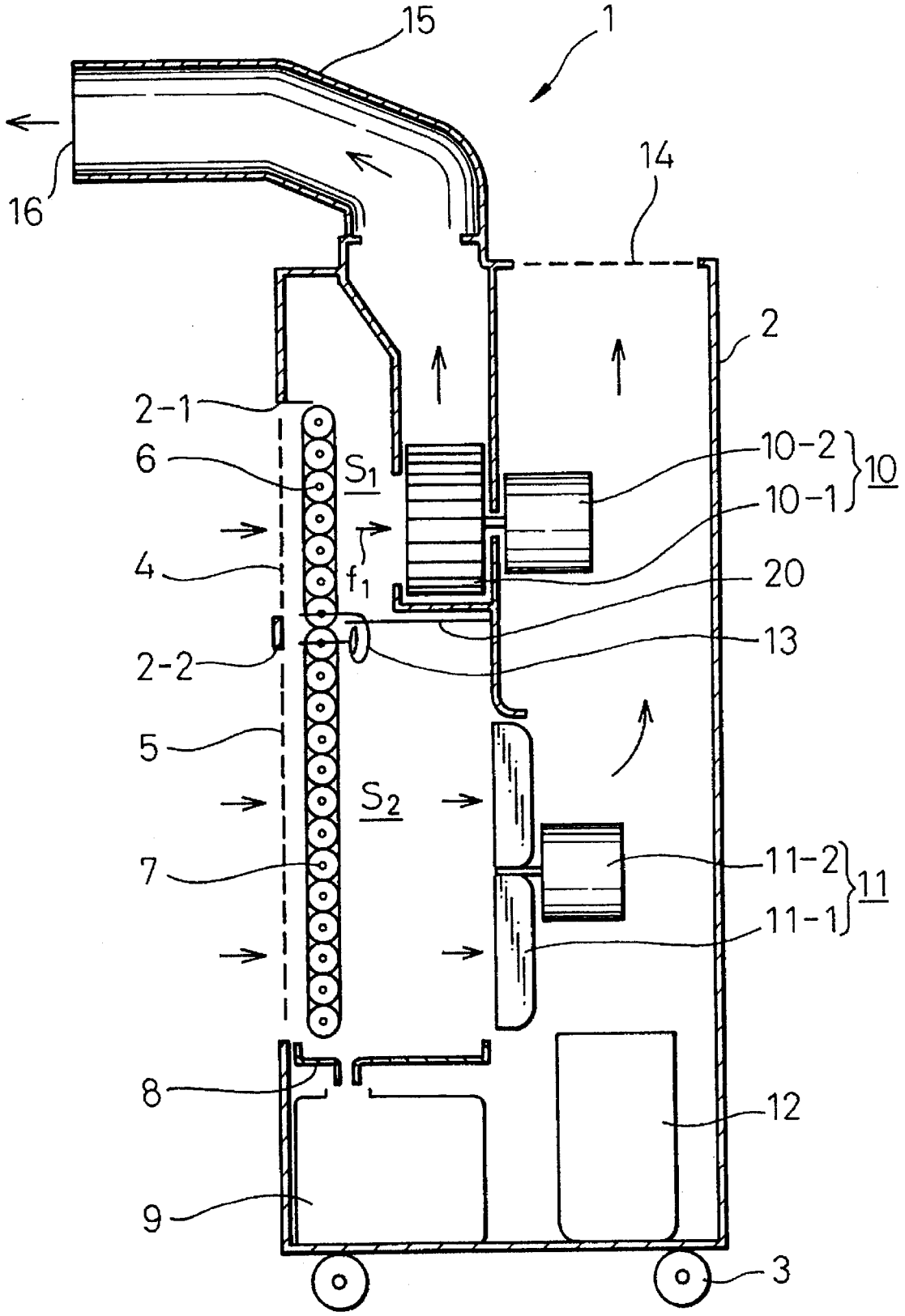
FIG. 1 is a cross sectional view of an integrated refrigerating apparatus according to the present invention.
Figure 2:
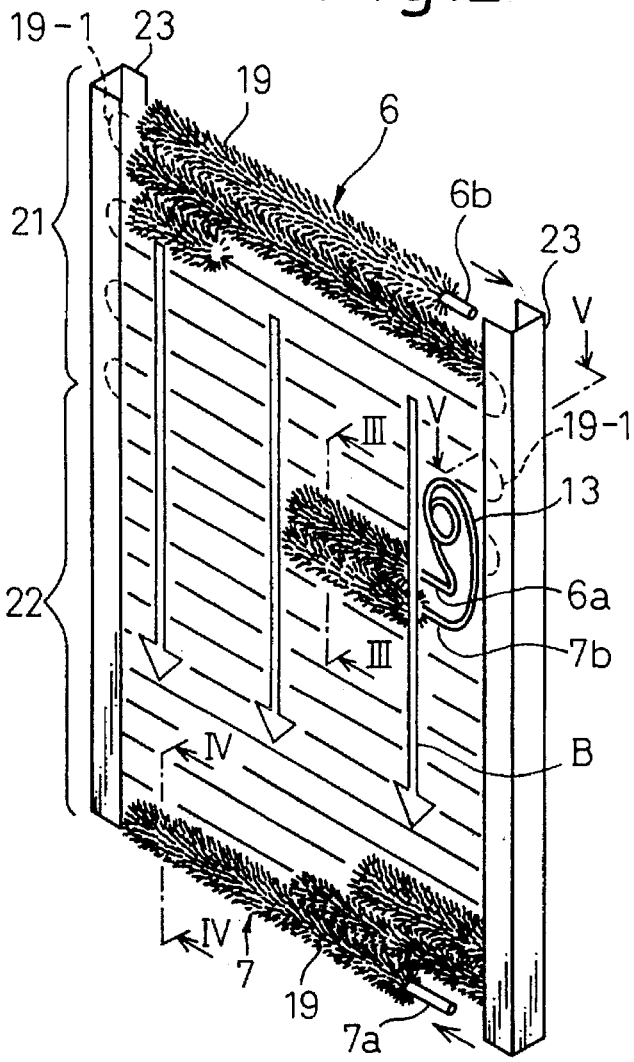
FIG. 2 is a perspective view of an evaporator and a condenser in the refrigerating apparatus in FIG. 1.

In FIGS. 1 and 2, a reference numeral 1 denotes a refrigerating apparatus including a casing 2 of an elongated rectangular parallelepiped shape. The casing 2 has a bottom, to which wheels 3 are rotatably connected, which allows the refrigerating apparatus 1 to be easily moved along a floor of a factory or office.

In the casing 2, an evaporator 6 and a condenser 7 are arranged so that the evaporator 6 and the condenser 7 form a vertically extending integrated refrigerating unit. Inside the space in the casing 2, the evaporator 6 is located at an upper part, while the condenser 7 is located at a lower part. The casing 2 has, at its front wall, an opening 2-1, to which a filter 4 is connected so that the filter 4 is located in front of the evaporator 6 and an opening 2-2, to which a filter 5 is connected so that the filter 5 is located in front of the condenser 7.

Arranged also in the casing 2 is a drain pan 9, which is located below the condenser 7 in such a manner that a water from the unit is received by the pan 9. A drain tank 9 is located below the drain pan 9 so that the condensed water received by the pan 8 is finally introduced into the tank 9.

A fan device 10, which is constructed by a fan member 10-1 of radial flow type and an electric motor 10-2 connected to the fan member 10-1, is arranged in the casing 2. The fan member 10-1 is arranged so as to face the evaporator 6. Furthermore, a fan device 11, which is constructed by a fan member 11-1 of axial flow type and an electric motor 11-2 connected to the fan member 11-1, is arranged in the casing 1. The fan member 11-1 is arranged so as to face the condenser 7.

At the bottom in the space inside the casing 2, a compressor 12 is arranged.

A capillary 13 as a pressure reducer is arranged between the evaporator 6 and the condenser 7. Namely, as shown in FIG. 2, the evaporator 6 has an inlet **6*a* at a lower part thereof, while the condenser 7 has an outlet 7*b* at an upper part thereof. The capillary 13 connects the refrigerant inlet 6*a* of the evaporator 6 and the refrigerant outlet 7*a* of the condenser 7**.

In a well known manner, a recirculated pipe line (not shown) is constructed, which connects the compressor 12, evaporator 6, the capillary 13, and the condenser 7, with each other so that a recirculation of the refrigerant is done.

As shown in FIG. 1, in the casing 2, a hot air duct 14 is provided, which has a lower inlet connected to the fan member 11-1 of the condenser fan 11 for receiving a hot air flow after contacted with the condenser 7 and sucked by the fan 11 and an upper outlet end for discharging the hot air flow outwardly. A cool air duct 15 is also provided, which has a lower inlet end connected to the fan member 10-1 of the evaporator fan 10 for receiving a cold air flow after contacted with the evaporator 6 and sucked by the fan 10 and an upper outlet end 16 for discharging the cold air flow outwardly.

Figure 4:
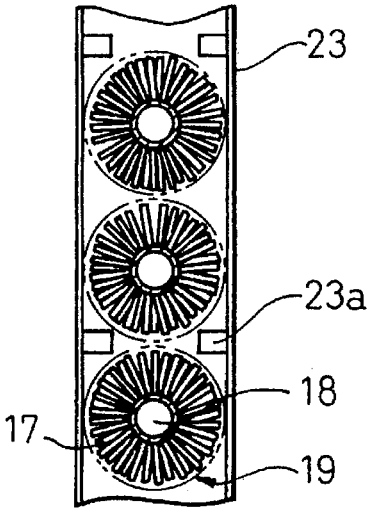
FIG. 4 is a cross sectional view taken along a line IV—IV in FIG. 2.

The evaporator 6 and the condenser 7, which are integrated as a unit as shown in FIG. 2, have basically the same construction. Namely, each of the evaporator 6 and the condenser 7 is constructed by a plurality of vertically spaced and horizontally extending spin fin tubes 19 which are, in a serpentine form, connected in series by means of U-shaped portions 19-1. As shown in FIG. 4, the integrated unit includes heat exchanging tubes 18 of a circular cross-sectional shape and a plurality of spine fins 17 formed as rectangular strips fixedly connected to an outer cylindrical surfaces of the heat exchanging tubers along the entire cylindrical surface of the heat exchanging tubes 18.

The spine fins 17 and the circular cross-sectioned tubes 18 for constructing the spine fin tubes 19 are made of a metal material of an increased heat conductivity as well as an increased corrosion resistance, such as aluminum. In order to obtain the spine fin tube 17, first, a hydrophilic coating is created on an aluminum sheet. The hydrophilic coating is, for example, produced by applying a hydrophilic acrylic resin on the aluminum plate for an amount of, for example, 1 to 5 mmg/dm$^2$. The sheet with the hydrophilic coating is, then, formed as a slitted strips. Namely, the sheet is, along the length thereof, formed with slitted strips. Then, the slitted aluminum strips are spirally wounded on the outer cylindrical surface of the circular tubes 18 and are fixed thereto by suitable means such as a welding. As a result, the strips as the spine fins 17 extend radially along the entire circumference and the length of the outer cylindrical surface, thereby providing the spine fins 17.

As shown in FIG. 2, the spine fin tubes 19 are arranged so that they are, in parallel, vertically spaced in a vertical plane, so that two vertically-spaced groups 21 and 22 of the spine fin tubes 19 are constructed. The spine fin tubes 19 in the upper group 21 construct the evaporator 6, while the spine fin tubes 19 in the lower group 22 construct the condenser 7.

Figure 3:
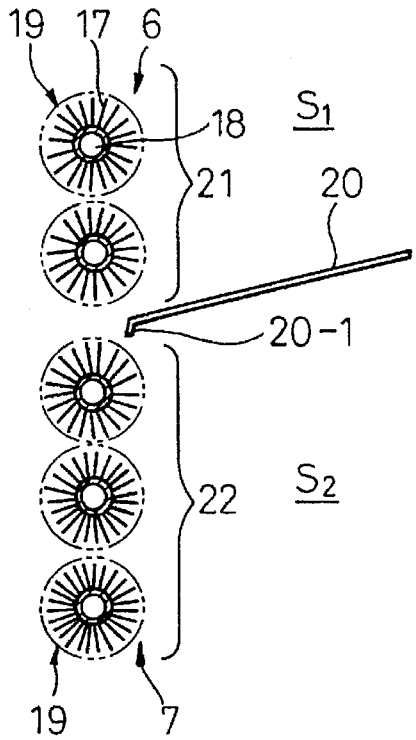
FIG. 3 is a cross sectional view of at a boundary between the evaporator and the condenser in FIG. 2 taken along a line III—III in FIG. 2.

As shown in FIG. 1, a partition plate 20 is arranged in the casing 2, so that the space inside the casing is divided into a portion $S_1$ opened to the evaporator 6 (the group 21 of the spine fin tubes 19) and a portion $S_2$ opened to the condenser 7 (the group 22 of the spine fin tubes 19). As shown in FIG. 3, the partition plate 20 has a downwardly bent end 20-1, which is located at a location between the spine fin tube 19 at the bottom of the section 21 and the spine fin tube 19 at the top of the section 22. The location of the downwardly bent end 20-1 of the plate 20 is slightly offset with respect to the axis of the spine fin tube 19 as shown in FIG. 3 in a direction of the air flow as shown by an arrow $f_1$ by the fan 10 in FIG. 1. The partition plate 20 is, in FIG. 3, slightly inclined upwardly toward the direction of the air flow $f_1$. As a result, droplets of drained water from the spine fin tubes 19 of the evaporator 6 are received by the partition plate 20.

Figure 5:
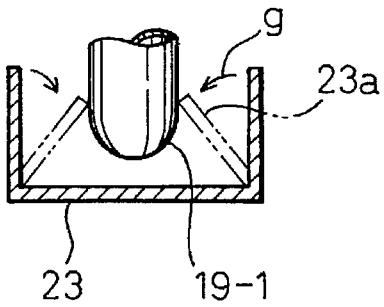
FIG. 5 is a cross sectional view taken along a line V—V in FIG. 2.

As shown in FIG. 2, a pair of horizontally spaced and vertically extending brackets 23 having C cross-sectional shaped channels are provided. The brackets 23 are arranged so that the channels are faced with each other. The U-shaped portions 19-1 at the ends of the spine fin tubes 19 are received by the C-shaped channels of the brackets 23 and are connected thereto, thereby fixing, in place, the evaporator 6 as well as the condenser 7. The brackets 23 are made form a metal material, such as a steel or aluminum. Furthermore, as shown in FIG. 5, the brackets 23 are provided with, at the bottom of the channels, vertically spaced horizontal pairs of slitted portions 23*a* for holding the U-shaped portions 19-1 of the spine fin tubes 19. Namely, after the U-shaped portions 19-1 are stored into the channels of the brackets 23, a suitable tool is contacted with the slitted portions 23*a* at their outer surfaces, and then the slitted portions 23*a* are inwardly depressed by the tool as shown by an arrow g in FIG. 5, until the portions 23*a* are contacted with the U-shaped portions 19-*a* of the spine fin tubes 19. As a result, a positive positioning and fixation of the U-shaped bent portions 10-1 to the brackets 23 is obtained.

Now, an operation of the first embodiment of the present invention will be explained. In order to start the operation of the air conditioning device the compressor 12 and the fans 10 and 11 are made ON. The operation of the compressor 12 causes a recirculation of the refrigerant to be created. Namely, the refrigerant at high pressure and high temperature from the compressor 12 is introduced, via the inlet 7*a*, to the condenser 7, whereat a heat exchange occurs between the refrigerant passing through the condenser 7 and the air flow induced by the fan 11, thereby condensing the refrigerant, while the air flow is heated. The condensed refrigerant from the condenser 7, from its outlet 7*b*, issues into the capillary tube 13, whereat the pressure of the refrigerant is reduced, so that a gas-liquid combined state of the refrigerant is obtained. The refrigerant is, then, introduced into the evaporator 6 from its bottom inlet 6*a*. At the evaporator 6, a heat exchange occurs between the refrigerant and the air flow induced by the fan 10. As a result, the refrigerant is evaporated, while the air flow is cooled by a latent heat of evaporation. The cooled air issues from the duct 15 to a desired site in the factory or office. The evaporated refrigerant in the evaporator 6 is, from its outlet 6*b*, again, sucked by the compressor 12, so that a refrigerating cycle is completed, and this cycle is repeated.

At the evaporator 6, the air flow contacting thereto is cooled, which causes the water component in the air flow to be condensed, thereby generating water droplets. Due to the arrangement of the spine fin tubes 19 in the same vertical plane so that the evaporator 6 is located above the condenser 7, the water from the evaporator 6 drops onto the condenser 7 as shown by arrows B in FIG. 2. Since all of the spine fin tubes 19 under the serpentine arrangement constructing the condenser 7 are arranged on the same vertical plane, an increased chance of the contact of the droplets of the drained water with the spine fine tubes is obtained. In other words, a time of duration where the droplets of the water with respect to the spine fin tube is prolonged, thereby obtaining an effective evaporation of the water. In other words, an increased amount of the evaporation is obtained. In addition, the downwardly directed flows of the water directed to the condenser 7 occur along the large number of the radially projecting spine fins 17 on the horizontally extending heat exchanging tubes 19. As a result, a uniform distribution of the water is obtained along a horizontal direction of the condenser 7. Furthermore, the spine fins 17 in the spine fin tubes 19 constructing the evaporating area 22 are, at their outer surface, formed with a hydrophilic coating, which allows a film water to uniformly spread along the entire surface of the fin 17, thereby obtaining an effective evaporation of the water.

Furthermore, each of the spine fin tubes 19 has, at its ends, portions with no spine fins, i.e., the U-shaped portions 19-1. In other words, the spine fin tubes 19 are independent of each other in the vertical direction. In other words, a continuation of the spine fines 17 between the vertically spaced spine fin tubes 19 are interrupted at the location of the U-shaped end portions 19-1, which prevents the water from being transmitted along the spine fins, thereby increasing the time when the drain water stays on the spine fin tubes 19.

In short, according to the present invention, an increased amount of the drained water is treated at the evaporator 7.

Figure 6:
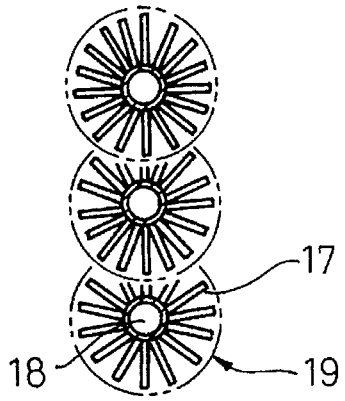
FIG. 6 shows a second embodiment of a partly overlapped arrangement of a spine fin tube.

FIG. 6 shows a modification of an arrangement of the spine fin tubes 19. In the arrangement in the first embodiment, the serpentine arrangement of the spine fin tubes 19 are such that the spine fins 17 between the adjacent spine fin tubes 19 are vertically separated with each other as shown in FIG. 4. Contrary to this, in FIG. 6, the spin fins 17 between the vertically adjacent spine fin tubes 19 are in a vertically overlapped condition. This arrangement is advantageous from the view point to increase a space efficiency, thereby obtaining a heat exchanging unit of a reduced size.

Figure 7:
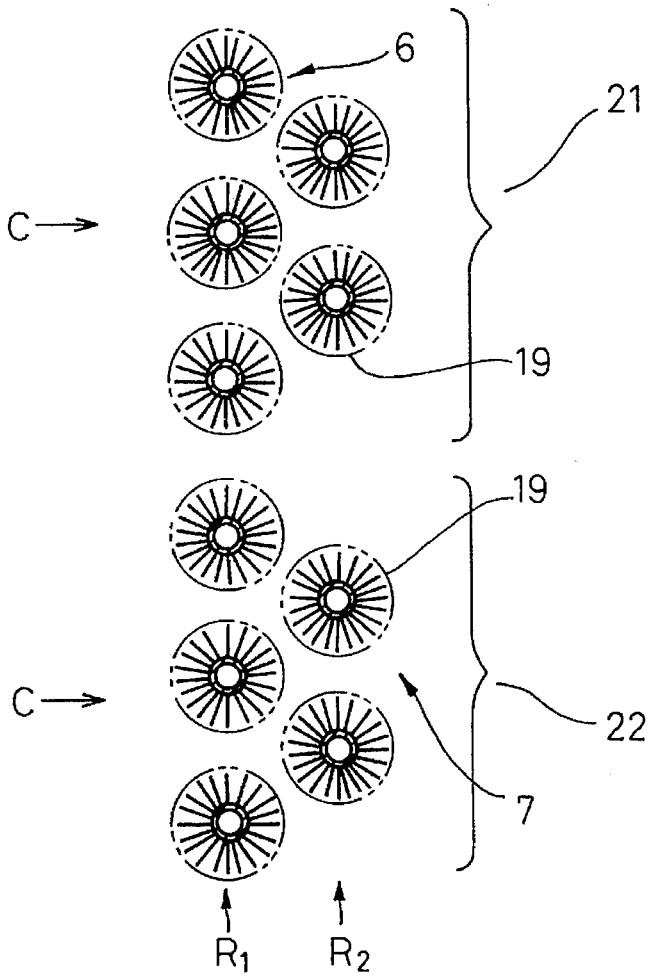
FIG. 7 shows a third embodiment of double row arrangement of spine fin tubes.
Figure 8:
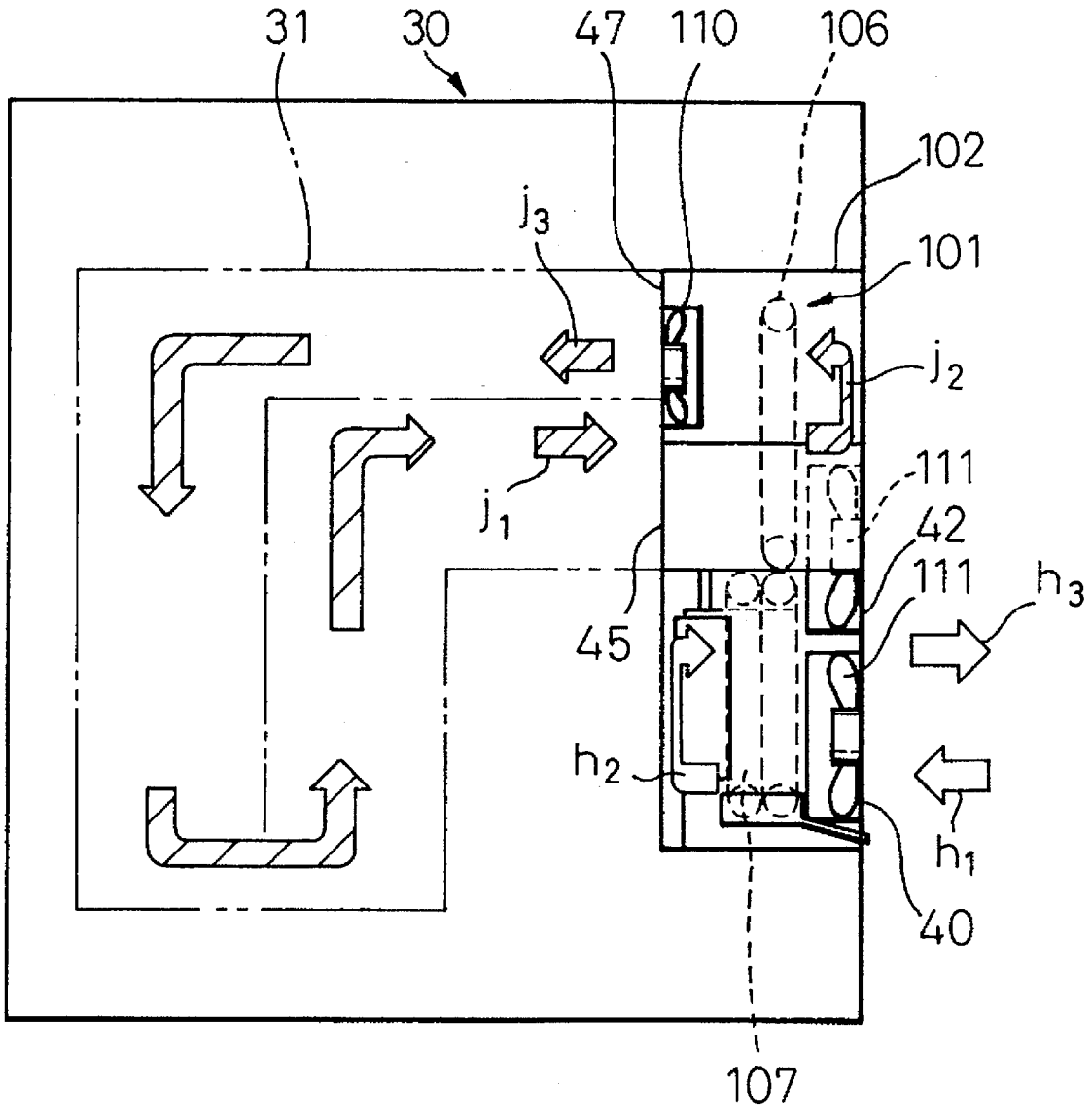
FIG. 8 shows a fourth embodiment directed to an application to a cooling of an electric control device.

FIG. 7 shows a third embodiment, wherein, in place of the single vertical row arrangement of the spine fin tubes in the first and second embodiments as shown in FIGS. 4 and 6, the third embodiment proposes two row arrangement of the spine fin tubes, wherein a first and second vertical rows $R_1$ and $R_2$ of the spine fin tubes 19 are provided in such a manner that the spine fin tubes 19 are arranged under a zigzag relationship between the two rows $R_1$ and $R_2$. This two row arrangement is advantageous in that an increased heat exchanging area can be obtained in a direction of the air flow as shown by an arrow C. In other words, a reduction in the area of front surface of the heat exchanger, which corresponds to the areas of the filters 4 and 5.

Figure 9:
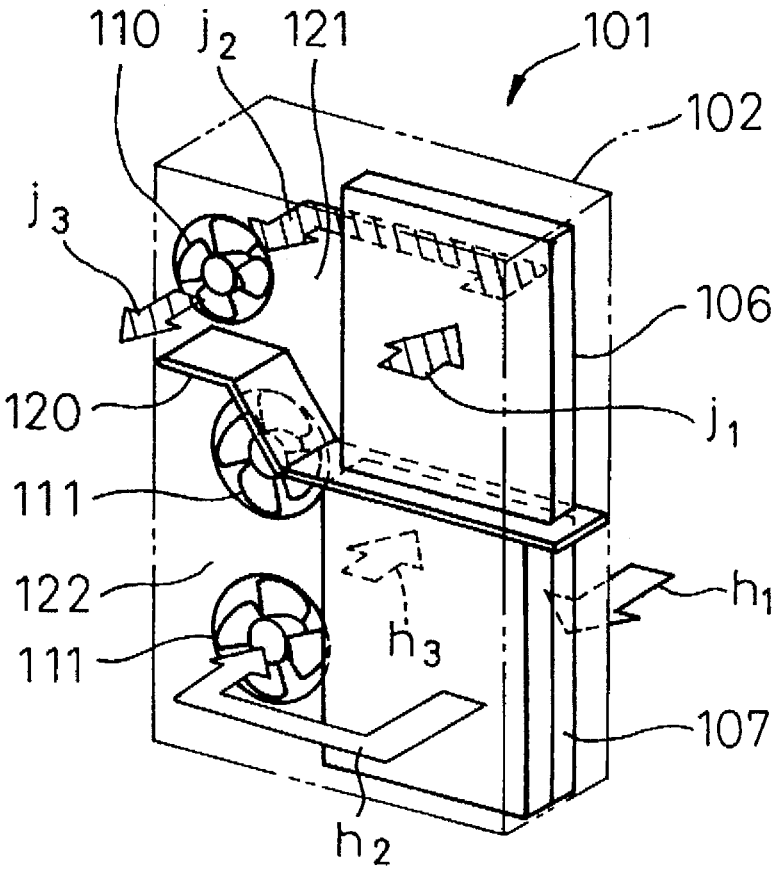
FIG. 9 is a schematic perspective view illustrating a construction of the refrigerating apparatus in the fourth embodiment in FIG. 8.
Figure 10:
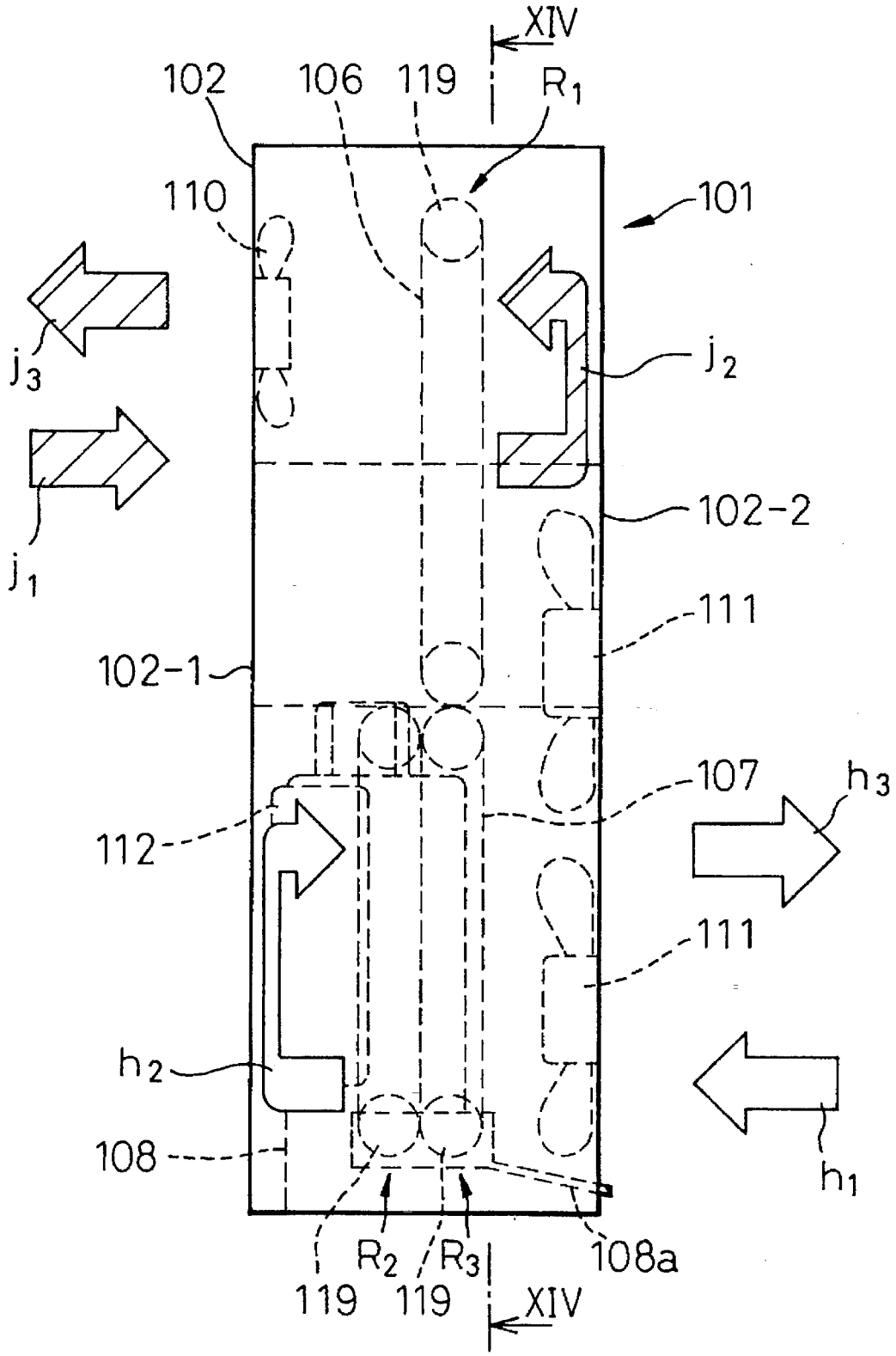
FIG. 10 is a side elevational view of the refrigerating apparatus in the fourth embodiment.
Figure 11:
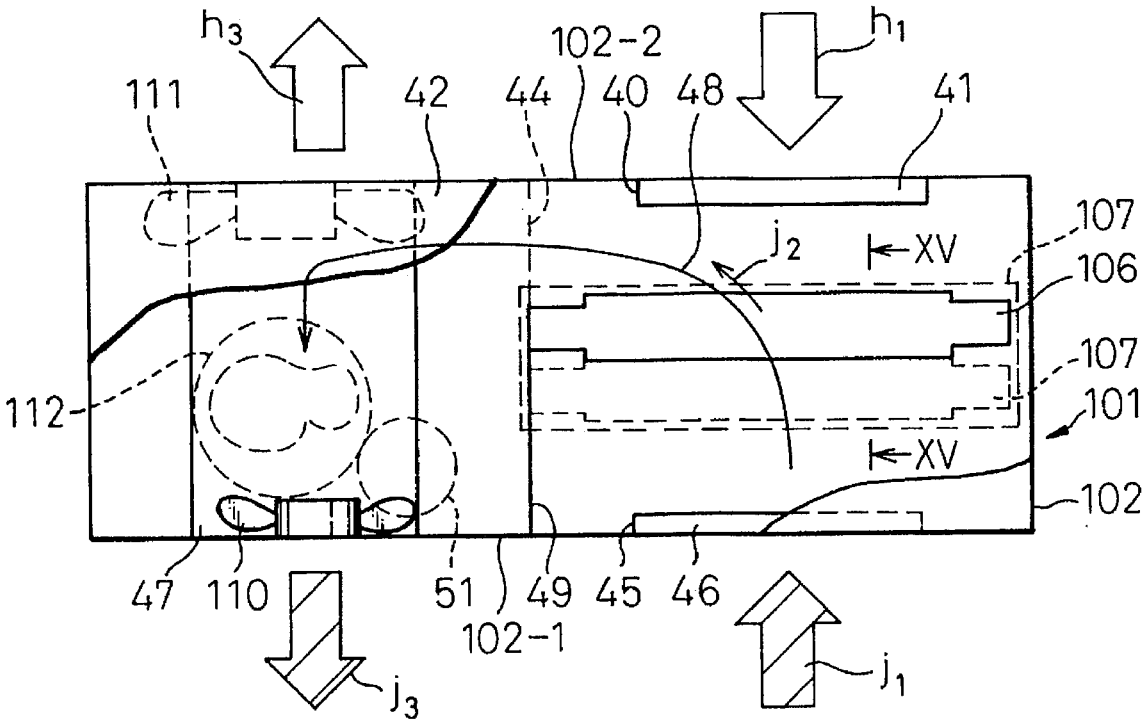
FIG. 11 is a top elevational view of the refrigerating apparatus in the fourth embodiment.

FIGS. 8 to FIG. 15 illustrate a fourth embodiment as a refrigerating apparatus for an electronic control device or box used in a factory for various purposes. Namely, in FIG. 8, a reference numeral 30 denotes such an electric board, which includes electronic parts, such as an electromagnetic switches, which generate certain amount of heat during their operation. As a result, cooling of such parts are essential for obtaining the designated functions thereof. Thus, according to the present invention, the electric control board 30 is formed therein with a cooling duct 31, in which the above mentioned parts (not shown) are arranged so as to allow the latter to contact the air flow in the duct 31 and cold air from a refrigerating apparatus of a construction according to the present invention is recirculated in the duct 31. In this embodiment, the refrigerating apparatus has, in principle, the same construction as that of the refrigerating apparatus 1. Thus, the components of the similar function are designated by the same reference numeral while adding 100. As shown in FIGS. 9 and 10, a refrigerating unit 101 includes a casing 102 having a front wall 102-1 and a rear wall 102-2 extending in a direction of a width of the casing and spaced in a direction of a thickness of the casing. An evaporator 106 and a condenser 107 are arranged inside the casing 102 at a location between the front and the rear walls 102-1 and 102-2 at a right-handed portion of the space inside the casing 102 as shown in FIG. 11. As similar to the previous embodiments, the arrangement is such that the evaporator 106 is at the top, while the condenser 107 is at the bottom. Each of the evaporator 106 and the condenser 107 is constructed by a serpentine arrangement of spine fin tubes 119 (FIG. 15) of the similar construction as shown in FIG. 2. As in FIG. 2 of the first embodiment, a pair of horizontally spaced brackets 123 (FIG. 12) are provided for holding looped portions 119-1 of the spine fins 119. A partition plate 120, which extends horizontally, is arranged between the evaporator 106 and the condenser 107, so that an evaporating area 121 is formed in the casing 102 above the partition plate 120, while a condensing area 122 is formed in the casing 102 below the partition plate 120. The partition plate 120 is formed with openings which allow water from the evaporator 106 to drop onto the condenser 107. In this fourth embodiment, as shown in FIG. 10, the evaporator 106 is constructed of a single vertical row R1 of the spine fin tubes 119, while the condenser 107 is constructed by double rows R2 and R3 of the spine fin tubes 119. As a result, in comparison with the evaporator 106, the condenser 107 has a larger thickness the direction of flows of the air. Furthermore, at the condenser 107, the direction of the cooled flow is such that the air flow is introduced into the condenser 107 from its rear side as shown by an arrow h1. The air flow after heat exchange at the evaporator issues from the front side of the condenser 107 as shown by an arrow h2 and is discharged from the casing 102 as shown by an arrow h3. Finally, as shown in FIG. 10, the arrangement of the forward row R2 of the spine fin tubes 119 in the condenser 107 located below the evaporator 106 is such that the row R2 is projected forwardly with respect to the evaporator 106 in the direction of the air flow in the condenser 107. See also FIG. 15.

Figure 13:
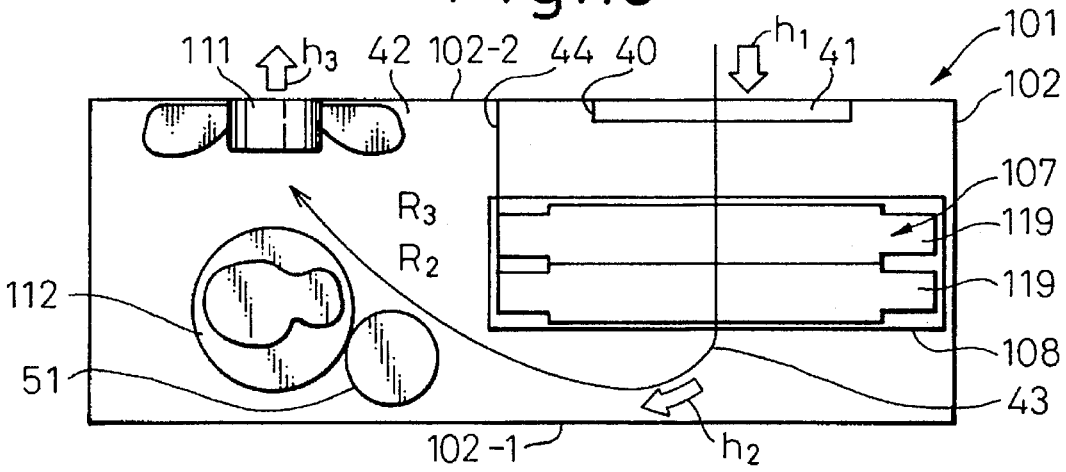
FIG. 13 is a cross sectional view taken along a line XIII—XIII in FIG. 12.

The casing 102 is formed with an outside (atmospheric) air inlet 40 at a right-handed side of a lower portion of its rear wall 102-2 as shown in FIG. 13 and faceing the condenser 107. The inlet 40 is for sucking outside air as shown by the arrow h1. At the inlet 40, an air filter 41, which corresponds to the air filter 5 in FIG. 1, is arranged for removing dust included in the atmospheric air sucked via the inlet 40.

Furthermore, the casing 102 is formed with an air outlet 42 at a left-handed side of the lower portion of the rear wall 102-2 spaced from the condenser 107 in FIG. 13. The outlet 42, which corresponds to the hot air outlet 14 in FIG. 1 in the first embodiment, is for discharging heated air after it has passed through the condenser 107. A pair of vertically spaced fans 111 are arranged in the casing 102 inwardly of the outlet 42 for generating an air which flow contacts the condenser 107. In the casing 102, a U-shaped condenser side air passageway 43 (FIG. 13) is formed, which passageway 43 is for generating, when the fans 11 are operated, an outside air flow taken from the air inlet 40 and directed to the air outlet 42 via the condenser 107 as shown by the arrows $h_1$, $h_2$ and $h_3$. In FIG. 13, a partition wall 44 is shown, which is a member which cooperates with the casing 102 to form the U-shaped condenser passageway 43.

In FIG. 11, the casing 102 is formed with an inside air inlet 45 at a right-handed side of the upper portion of the front wall 102-1 of the casing 102 faced with the evaporator 106 for introduction, from the refrigerating device 101, of air into the electric board 30 as shown by an arrow $j_1$. An air filter 46, which corresponds to the air filter 4 in FIG. 1 in the first embodiment, is arranged at the inside air inlet 45. In FIG. 11, the casing 102 is further provided with an inside air outlet 47 at a left-handed side of the upper portion of the front wall 102-1 of the casing 102 remote from the evaporator 106 to discharge a cooled air flow as shown by an arrow $j_2$ after exchanging heat with the evaporator 10, toward the duct 31 as shown by an arrow $j_3$, in which duct 31 the elements of the electric board 30 to be cooled are arranged. Furthermore, an evaporator fan 110 is arranged in the casing 102 at a location inwardly of the outlet 47. In the casing 102, a U-shaped evaporator side air passageway 48 (FIG. 11) is formed, which passageway 48 is for generating, when the fans 10 is operated, an inside air flow taken from the inside air inlet 45 and directed to the inside air outlet 47 via the evaporator 106 as shown by the arrow $j_1$, $j_2$ and $j_3$. In FIG. 11, a partition wall 49 is shown, which is a member which cooperates with the casing 102 to form the U-shaped evaporator sided air passageway 48.

Figure 12:
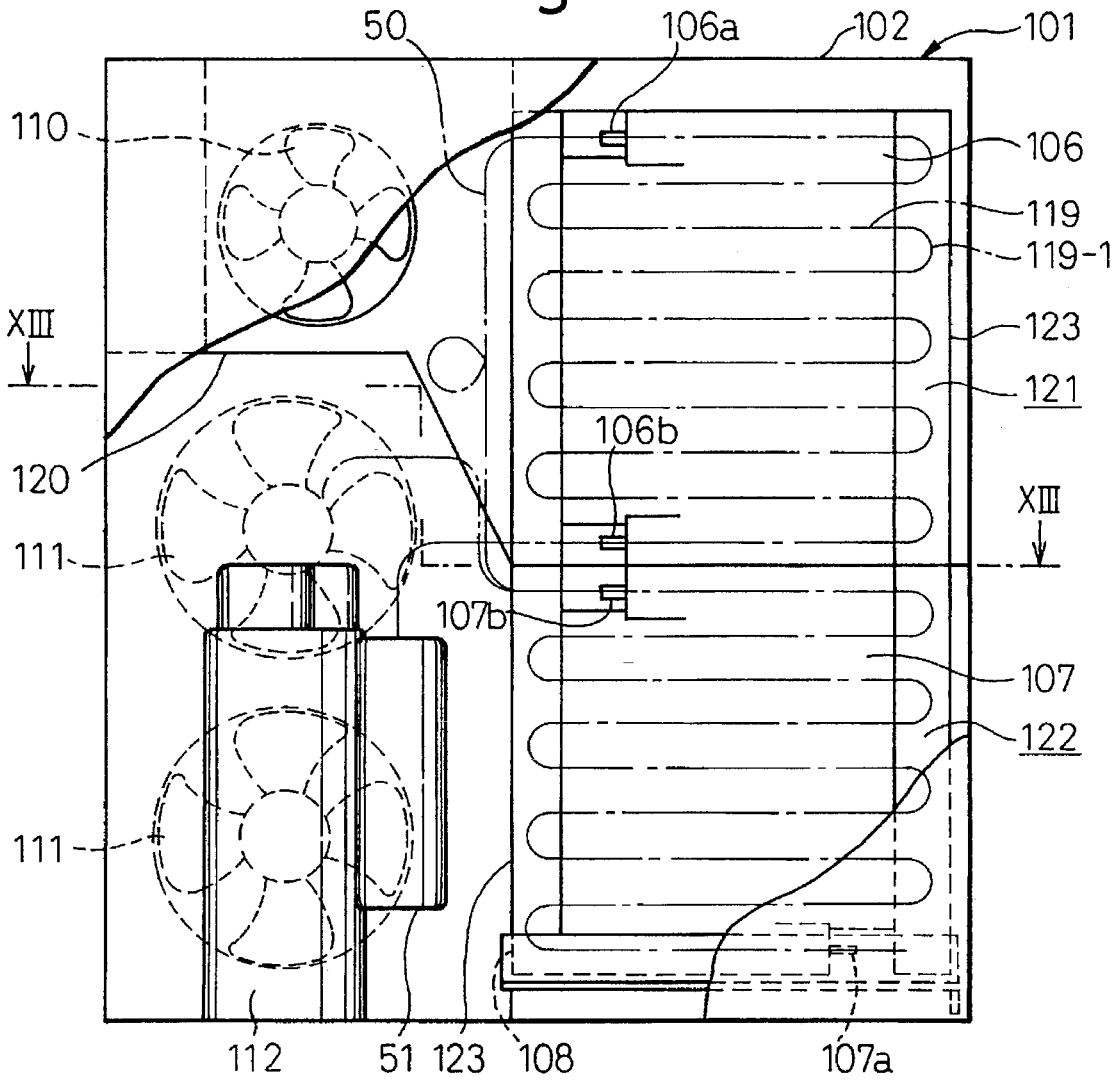
FIG. 12 is a front elevational view of the refrigerating apparatus in the fourth embodiment.
Figure 14:
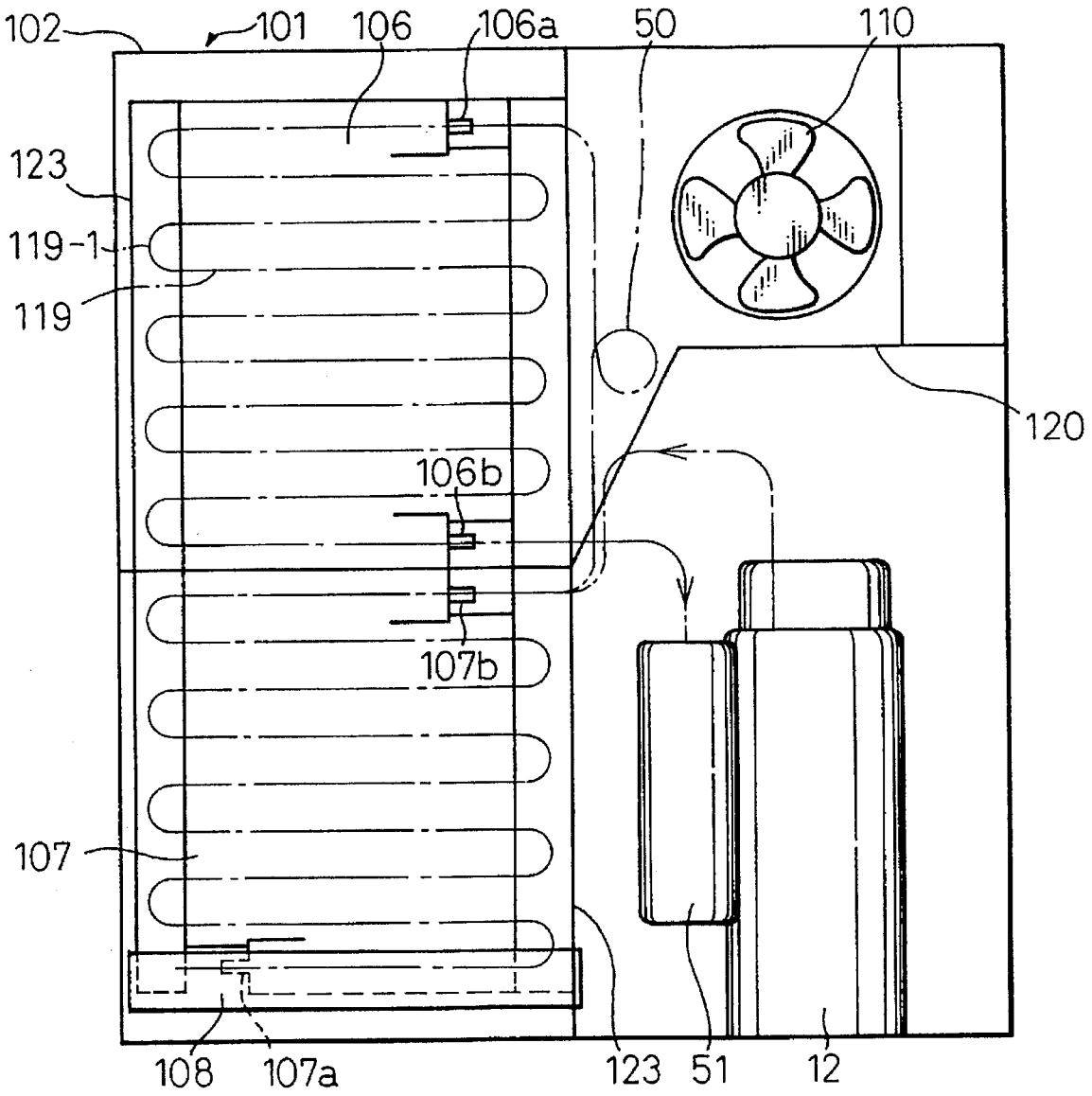
FIG. 14 is a cross sectional view taken along a line XIV—XIV in FIG. 10.

In FIGS. 12 and 14, a capillary tube 50 is arranged between an outlet **107*b* of the refrigerant of the condenser 107 and an inlet 106*a* of the refrigerant of the evaporator 106, and functions to reduce the pressure of the liquid state refrigerant. In this embodiment, the refrigerating system is an accumulator type. Namely, an accumulator 51 (FIGS. 12 and 14) is arranged between the outlet 106*b* of the refrigerant of the evaporator 106 and the inlet (not shown) of the refrigerant of the compressor 112. The accumulator function to temporary store the refrigerant under a liquid state, so that the refrigerant under a gaseous state is introduced into the compressor 112. The compressed gaseous refrigerant from the compressor 112 is introduced into the inlet 107*a* of the condenser 107**.

As similar to the first embodiment in FIG. 1, a pan 108 is arranged at the lower portion of the casing 102 for receiving the water dropped from the evaporator 106 while contacting with the condenser 107. As shown in FIG. 10, a drain pipe **108*a* is connected to the bottom portion of the drain pan 108. The drain pipe 108*a* extends from the drain pan 108**, while inclining downwardly, so that the drained water is discharged outwardly.

Now, the operation of the above embodiment will be explained. By a rotating movement of the fans 111 generated by an energization of its rotating motors (not shown), a flow of an outside air (atmospheric air) is generated along the condenser side air flow passageway 43 (FIG. 13). Namely, the outside air is taken into the condenser 107 as shown by the arrow $h_1$, then is moved, as shown by the arrow $h_2$, along the partition wall 44, and is finally discharged outwardly from the fan 111 as shown by the arrow $h_3$. In this way, at the condenser 107, a heat exchange is obtained between the outside air and the refrigerant in the condenser 107. Similarly, by a rotating movement of the fans 110 generated by an energization of its rotating motors (not shown), a flow of an inside air is generated along the evaporator side air flow passageway 48 (FIG. 11). Namely, the air inside the electric board 30 (inside air) is taken into the 106 as shown by the arrow $j_1$, then is moved as shown by the arrow $j_2$ along the partition wall 49, and is finally discharged outwardly from the fan 110 as shown by the arrow $j_3$. In this way, at the evaporator 106, a heat exchange is obtained between the inside air and the refrigerant in the evaporator 106.

At the evaporator 106, the inside air flow after contacted the evaporator as shown by the arrow $j_2$ is cooled and dehumidified, while the refrigerant is warmed up, thereby evaporating the refrigerant. The fan 10 generates a recirculated flow of the cooled and dehumidified air discharged to the air flow duct 31 in the electric control board 30 as shown by the arrow $j_3$. The recirculated flow of the cooled and dehumidified air in the air flow duct 31 causes the electric parts (not shown) in the electric control board 30 generating heat to be cooled. The inside air flow is, again, sucked into the evaporator 106 as shown by the arrow j1, thereby repeating the above cycle.

At the condenser 107, the outside air flow after contacted with condenser 107 as shown by the arrow $h_2$ is warmed up, while the refrigerant of a high temperature is cooled, thereby condensing the refrigerant. The fan 111 issues a flow of the warmed up air discharged to the atmosphere as shown by the arrow h3. An atmospheric air is, again, sucked into the condenser 107 as shown by the arrow h1. The cooling and dehumidifying of the inside air at the evaporator 106 causes condensed water to be generated. Thus, the water D (FIG. 15) generated at the evaporator 106 is dropped to the surfaces of the spine fins 117 of the spine fin tubes 119 constructing the condenser 107 located downwardly from the evaporator 106. Thus, the water is heated by the high temperature of the refrigerant in the condenser 107, thereby evaporating the water, while the refrigerant in the condenser 107 is cooled. As explained with reference to the first embodiment, the construction of the condenser 107 from the spine fin tubes 119 allows the drained water to be evenly distributed along the entire part of the condenser 107, thereby obtaining an effective evaporating operation.

Figure 15:
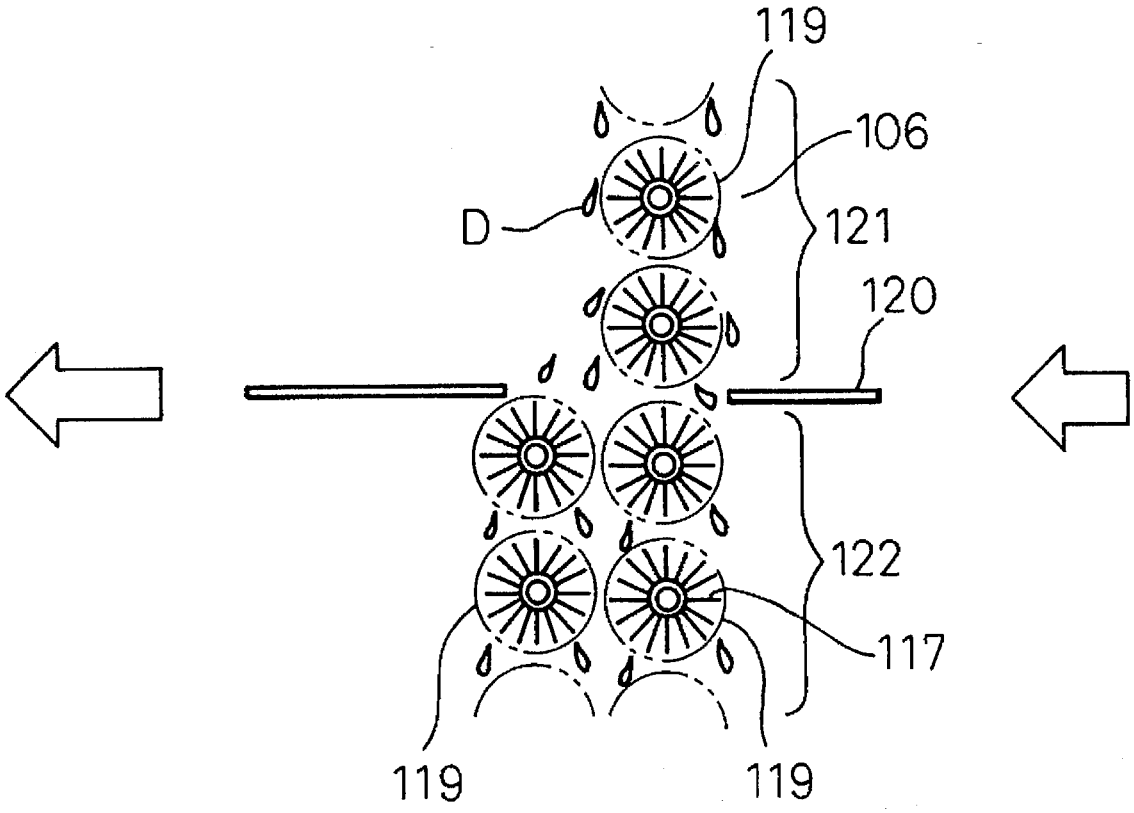
FIG. 15 is a cross sectional view taken along a line XV—XV in FIG. 11, illustrating a double row arrangement of the condenser.

The drained water not evaporated at the condenser 107 is received by the drain pan 108 and is discharged outwardly of the casing 102 via the tube 108*a*. In this embodiment, in comparison with the evaporator 106, the thickness of the condenser 107 is increased in the direction of the flow of the air flow, in such a manner that the condenser 107 is projected out of the evaporator 106 toward the downward direction of the air flow as shown in FIG. 15. As a result, the drain water D from the evaporator 106 is, while being entrained by the flow of the air as shown by an arrow, dropped not only to the upstream row of the spine fin tubes 19 of the condenser 107 but also to the downstream row of the spine fin tubes 19 of the condenser 107. In short, the two row arrangement of the spine fin tubes 19 of the condenser 107 in this embodiment is effective for obtaining an increased evaporation of the water.

Furthermore, in the fourth embodiment, the compressor 112 is arranged in the condenser side air flow passageway 43 as shown in FIG. 13. Namely, the air flow generated by the rotating fan 111 is, after passing through the condenser 107, contacted with the compressor 112, thereby cooling the compressor 112. According to the present invention, an additional heat exchange is obtained between the water dropping from the evaporator and the refrigerant in the condenser, thereby enhancing the cooling capacity at the condenser. According to the test conducted by inventors, an increase in the condensing capacity of a value about 30% can be obtained over the construction where the drained water at the evaporator is not dropped to the condenser. As a result of the increase in the condensing capacity, a reduction in compression capacity of a value about 6% is obtained at the compressor for maintaining the same air conditioning performance, thereby reducing the energy consumption.

In the fourth embodiment, the body 101 of the refrigerating device is arranged integrally in the electric control box 30 in such a manner that the condenser side air passageway 48 is at its air inlet 45 and air outlet 47 connected to the inner duct 30 of the electric control box 30. However, in place of this integrated construction, the body 101 of the refrigerating apparatus can be arranged outside the electric control box 30, and a separate outer duct can be provided for connecting the air inlet 45 and the air outlet 47 of the condenser side air passageway 48 with the inner duct 31 of the electric control box 30.

We claim:

1. A refrigerating apparatus comprising:

a compressor;

a condenser;

means for generating an air flow contacting the condenser for transferring heat from the condenser to the air flow;

an evaporator arranged at a location above the condenser;

means for generating an air flow contacted with the evaporator for transferring heat from the air flow to the evaporator; and a pressure reducer arranged between the condenser and the evaporator;

an arrangement of the compressor, the condenser, the evaporator and the pressure reducer being for executing a refrigerating cycle such that a compressed refrigerant from the compressor is condensed at the condenser and the refrigerant is, after pressure reduction at the pressure reducer, evaporated at the evaporator;

the evaporator and the condenser being oriented vertically in substantially the same plane;

the evaporator and the condenser being constructed by a serpentine arrangement of a spine fin tube comprising a central tube and spine fins on an outer cylindrical surface of the tube along substantially the entire length thereof, the spine fin tube of the evaporator being, at a bottom part thereof, in direct connection with a top part of the spine fin tube of the condenser; the spine fins at the bottom part of the spine fin tube of the evaporator and the spine fins at the top part of the spine fin tube of the condenser being in an overlap relationship thereby allowing condensate from said evaporator to drip vertically down through said evaporator and directly onto and through said condenser.

2. A refrigerating apparatus according to claim 1, wherein each of the spine fins is of a substantially rectangular shape strip extending radially from the outer cylindrical surface of the tube.

3. An apparatus according to claim 1, further including a partition which is arranged between the condenser and the evaporator for forming a boundary between an air passageway for the condenser and an air passageway for the evaporator, the partition wall extending in the direction of the flow of the air and having an upstream end which is under an offset arrangement with respect to the spine fin tubes without contacting with the spine fin tubes.

4. An apparatus according to claim 1, wherein the spine fin tubes are formed as a serpentine arrangement having a plurality of straight portions with which are vertically spaced in parallel and curved portions connecting the straight portions with each other, and means for obtaining a fixed arrangement of the spine fin tube in the casing, thereby obtaining an integrated construction of the evaporator and the condenser.

5. An apparatus according to claim 4, wherein said fixing means comprise a pair of horizontally spaced supporting members, each supporting member extending, substantially, vertically, and means for fixedly connecting the looped portions of the spine fin tube to the respective supporting members.

6. An apparatus according to claim 1, wherein said spine fin tube is provided, at its outer surface, with a coating made of hydrophilic material.

7. An apparatus according to claim 1, wherein the spine fin tube is formed as a serpentine arrangement having a plurality of straight portions which are vertically spaced in parallel, and wherein an arrangement of the straight portions is such that the spine fins are overlapped with each other between the straight portions which are vertically adjacent with each other.

8. An apparatus according to claim 1, further comprising a casing for storing the members for executing the refrigerating cycle including the compressor, the condenser, the evaporator and the pressure reducer, as well as the air flow generating means in the condenser and the evaporator, and wheel means at a bottom of the casing for allowing the casing to be desirably moved.

9. An apparatus according to claim 1, wherein said condenser has a thickness larger than that of the evaporator, and a portion of condenser thicker than the evaporator is projected in the downward direction in the flow of the air contacting the condenser.

10. An apparatus according to claim 1, further comprising:

a casing for storing the compressor and the condenser, the casing forming substantially a rectangular shape having a pair of spaced walls extending in a width direction of the casing and spaced in a thickness direction of the casing, the condenser and evaporator being arranged between the front and rear walls, the casing forming, at one of said walls, a first air inlet opening facing the evaporator for allowing an air flow to contact the evaporator and a first air outlet for discharging the air after contacting the evaporator, the casing forming, at the other wall, a second air inlet opening facing the condenser to allow an air flow to contact the condenser and a second air outlet for discharging the air after contacting the condenser, a first passageway of a substantially U-shape in the casing for generating the air flow passed through the first inlet, the evaporator and the first outlet, a second passageway of a substantially L-shape in the casing for generating the air flow passed through the second inlet, the condenser and the second outlet, and first and second blower means arranged in the first and second passageways, respectively.

11. A refrigerating apparatus comprising:

a compressor;

a condenser;

means for generating an air flow contacting the condenser for transferring heat from the condenser to the air flow;

an evaporator arranged at a location above the condenser;

means for generating an air flow contacted with the evaporator for transferring heat from the air flow to the evaporator;

a pressure reducer arranged between the condenser and the evaporator;

an arrangement of the compressor, the condenser, the evaporator and the pressure reducer being for executing a refrigerating cycle such that a compressed refrigerant from the compressor is condensed at the condenser and the refrigerant is, after pressure reduction at the pressure reducer, evaporated at the evaporator;

the evaporator and the condenser being located in substantially the same plane;

the evaporator and the condenser being constructed by a serpentine arrangement of a spine fin tube comprising a central tube and spine fins on an outer cylindrical surface of the tube along substantially the entire length thereof; and further comprising:

a casing for storing the compressor and the condenser, the casing forming substantially a rectangular shape having a pair of spaced walls extending in a width direction of the casing and spaced in a thickness direction of the casing, the condenser and evaporator being arranged between the front and rear walls, the casing forming, at one of said walls, a first air inlet opening facing the evaporator for allowing an air flow to contact the evaporator and a first air outlet for discharging the air after contacting the evaporator, the casing forming, at the other wall, a second air inlet opening facing the condenser to allow an air flow to contact the condenser and a second air outlet for discharging the air after contacting the condenser, a first passageway of a substantially U-shape in the casing for generating the air flow passed through the first inlet, the evaporator and the first outlet, a second passageway of a substantially L-shape in the casing for generating the air flow passed through the second inlet, the condenser and the second outlet, and first and second blower means arranged in the first and second passageways, respectively, wherein the apparatus is for cooling an electric control box having a passageway in which at least one member generating heat and to be cooled is arranged, and wherein said first air inlet and first air outlet is located in the passageway in the electric control board.

* * * * *